US008542851B2

(12) United States Patent
Kasai

(10) Patent No.: US 8,542,851 B2
(45) Date of Patent: Sep. 24, 2013

(54) ACOUSTIC SENSOR AND MICROPHONE

(75) Inventor: Takashi Kasai, Kusatsu (JP)

(73) Assignee: OMRON Corporation, Kyoto (JP)

( * ) Notice: Subject to any disclaimer, the term of this patent is extended or adjusted under 35 U.S.C. 154(b) by 118 days.

(21) Appl. No.: 13/105,440

(22) Filed: May 11, 2011

(65) Prior Publication Data

US 2011/0280419 A1 Nov. 17, 2011

(30) Foreign Application Priority Data

May 13, 2010 (JP) ..... 2010-110945
Mar. 30, 2011 (JP) ..... 2011-074454

(51) Int. Cl.
*H04R 25/00* (2006.01)

(52) U.S. Cl.
USPC ..... 381/175; 381/176

(58) Field of Classification Search
USPC ..... 381/174–176, 191
See application file for complete search history.

(56) References Cited

U.S. PATENT DOCUMENTS

| | | | | |
|---|---|---|---|---|
| 2002/0067663 | A1* | 6/2002 | Loeppert et al. | 367/181 |
| 2008/0232615 | A1* | 9/2008 | Song et al. | 381/174 |
| 2009/0136064 | A1 | 5/2009 | Suzuki et al. | |
| 2010/0135123 | A1* | 6/2010 | Fischer et al. | 367/181 |
| 2010/0176821 | A1* | 7/2010 | Kasai et al. | 324/660 |

FOREIGN PATENT DOCUMENTS

| | | | |
|---|---|---|---|
| JP | 2006-121465 A | | 5/2006 |
| JP | 2006121465 A | * | 5/2006 |
| JP | 2007-104195 A | | 4/2007 |
| JP | 2008-053400 A | | 3/2008 |
| JP | 2008-301434 A | | 12/2008 |
| JP | 2008301434 A | * | 12/2008 |
| JP | 2009-089097 A | | 4/2009 |
| JP | 4338395 B2 | | 10/2009 |
| WO | 02/15636 A2 | | 2/2002 |

OTHER PUBLICATIONS

Examination Report for Japanese Application No. 2011-074454 dated Nov. 1, 2011, with English translation thereof (5 pages).

Korean Office Action for Application No. 10-2011-0041609, mailed on Nov. 21, 2012 (7 pages).

Patent Abstracts of Japan for Japanese Publication No. 2008-053400, publication date Mar. 6, 2008 (1 page).

* cited by examiner

*Primary Examiner* — Suhan Ni
(74) *Attorney, Agent, or Firm* — Osha Liang LLP

(57) ABSTRACT

An acoustic sensor includes a semiconductor substrate with a back chamber, a conductive diaphragm arranged on an upper side of the semiconductor substrate, an insulating fixed film fixed on an upper surface of the semiconductor substrate covering the conductive diaphragm with a gap, a conductive fixed electrode film arranged on the insulating fixed film facing the diaphragm, an extraction wiring extracted from the conductive fixed electrode film, and an electrode pad to which the extraction wiring is connected. The acoustic sensor converts an acoustic vibration to change electrostatic capacitance between the conductive diaphragm and the conductive fixed electrode film. A plurality of acoustic perforations are opened in a back plate including the insulating fixed film and the conductive fixed electrode film. An opening rate of the plurality of acoustic perforations is smaller in the extraction wiring and a region in the vicinity thereof than in other regions.

12 Claims, 9 Drawing Sheets

ACOUSTIC SENSOR AND MICROPHONE

BACKGROUND OF THE INVENTION

1. Technical Field

One or more embodiments of the present invention relate to acoustic sensors and microphones, and specifically to an MEMS (Micro Electro Mechanical Systems) type acoustic sensor manufactured by using the MEMS technique, and a microphone using such acoustic sensor.

2. Related Art

A capacitance type acoustic sensor is disclosed in Japanese Patent Publication No. 4338395 and Japanese Unexamined Patent Publication No. 2009-89097. In the capacitance type acoustic sensor, a diaphragm (movable electrode film) is arranged on a front surface of a silicon substrate, a back plate is fixed on the front surface of the silicon substrate so as to cover the diaphragm, and a capacitor is configured by the fixed electrode film and the diaphragm of the back plate. The diaphragm is vibrated with the acoustic vibration, and the change in electrostatic capacitance between the fixed electrode film and the diaphragm in such case is output. A great number of acoustic holes are opened in the back plate because the acoustic vibration needs to be introduced to an air gap between the fixed electrode film and the diaphragm in order to vibrate the diaphragm with the acoustic vibration.

In such acoustic sensor, the opening size of the acoustic hole needs to be made large to enhance the S/N ratio. However, the acoustic hole that is opened in the back plate is opened not only at the plate portion having a relatively thick film thickness but also at the fixed electrode film having a thin thickness. Therefore, if the opening size of the acoustic hole is made large, the extraction wiring portion of the fixed electrode film may easily break or the parasitic resistance may increase.

SUMMARY OF INVENTION

One or more embodiments of the present invention have been devised to provide an acoustic sensor in which the fixed electrode film is less likely to break and the parasitic resistance is less likely to increase even if the opening size of the acoustic hole (acoustic perforation) opened in the back plate is made large.

In accordance with one aspect of one or more embodiments of the present invention, there is provided an acoustic sensor including: a semiconductor substrate including a back chamber; a conductive diaphragm arranged on an upper side of the semiconductor substrate; an insulating fixed film fixed on an upper surface of the semiconductor substrate to cover the diaphragm with a gap; a conductive fixed electrode film arranged on the fixed film at a position facing the diaphragm; an extraction wiring extracted from the fixed electrode film; and an electrode pad, to which the extraction wiring is connected; the acoustic sensor converting an acoustic vibration to change in electrostatic capacitance between the diaphragm and the fixed electrode film; wherein a plurality of acoustic perforations is opened in a back plate including the fixed film and the fixed electrode film; and an opening rate of the acoustic perforation is smaller in the extraction wiring and a region in the vicinity thereof than in other regions.

The opening rate is the ratio of the total of the opening area of the acoustic perforations with respect to the area of the region in the relevant region of an extent including a plurality of acoustic perforations. In order to reduce the opening rate of the acoustic perforations arranged in the extraction wiring and the region in the vicinity of the extraction wiring, the opening area per one acoustic perforation is to be reduced compared to other regions in the extraction wiring and the region in the vicinity of the extraction wiring. Alternatively, the inter-center distance between the adjacent acoustic perforations is made longer than other regions in the extraction wiring and the region in the vicinity of the extraction wiring.

If the extraction wiring and the region in the vicinity of the extraction wiring includes an acoustic perforation having a smaller opening rate than the acoustic perforation in other regions, this includes a case where the extraction wiring or the region in the vicinity of the extraction wiring does not include the acoustic perforation (i.e., opening rate is zero).

The region in the vicinity of the extraction wiring refers to the region within six times and may more specifically refer to the region within substantially three times the average inter-center distance of the acoustic perforation measured from the basal end of the extraction wiring of the acoustic perforation formed region (excluding the region where the extraction wiring passes) of the back plate.

In a first acoustic sensor of one or more embodiments of the present invention, the acoustic perforation in the extraction wiring and in the region in the vicinity thereof has a relatively small opening rate, and hence the width of the electrode film between the acoustic perforations in the extraction wiring and in the region in the vicinity thereof is less likely to become narrow and the parasitic resistance in the extraction wiring and in the region in the vicinity thereof can be reduced. Therefore, the generation of noise in the extraction wiring and in the region in the vicinity thereof can be reduced and the S/N ratio of the acoustic sensor can be enhanced. Furthermore, the width of the electrode film between the acoustic perforations can be widened in the extraction wiring and in the region in the vicinity thereof, so that the lowering of the strength of the fixed electrode film by the acoustic perforation in the extraction wiring and in the region in the vicinity thereof can be reduced. Therefore, the mechanical strength of the extraction wiring and the fixed electrode film increase, so that disconnection and breakage are less likely to occur.

In the first acoustic sensor of one or more embodiments of the present invention, the opening rate of the acoustic perforation is relatively large in other regions excluding the extraction wiring and the vicinity thereof so that the acoustic vibration easily passes through the acoustic perforation, and the S/N ratio of the acoustic sensor is increased to enhance the sensitivity.

One embodiment of the first acoustic sensor according to the present invention has the acoustic perforation arranged in the extraction wiring and the region in the vicinity of the extraction wiring, and the acoustic perforation in other regions excluding the extraction wiring and the region in the vicinity thereof arrayed according to the same rule. When referring to being arrayed according to the same rule, this means that the form of array (e.g., square arrangement and concentric arrangement, honeycomb arrangement, zigzag arrangement etc.) and the array pitch (inter-center distance between the acoustic perforations) are the same. According to one or more embodiments, the sacrifice layer of the air gap can be uniformly etched in the manufacturing step.

In accordance with an aspect, a diameter of the acoustic perforation having a relatively small opening area arranged in the extraction wiring or the region in the vicinity of the extraction wiring is smaller than twice a spaced distance between the acoustic perforations. According to one or more embodiments, the strength of the fixed electrode film can be ensured and the parasitic resistance can be reduced.

In accordance with an aspect, a diameter of the acoustic perforation having a relatively large opening area arranged in other regions excluding the extraction wiring and the region in the vicinity of the extraction wiring is greater than a spaced distance between the acoustic perforations. According to one or more embodiments, the S/N ratio of the acoustic sensor can be enhanced because the opening rate of the acoustic perforation becomes large in other regions excluding the extraction wiring and the region in the vicinity of the extraction wiring.

In accordance with an aspect, a diameter of the acoustic perforation having a relatively large opening area arranged in other regions excluding the extraction wiring and the region in the vicinity of the extraction wiring is smaller than four times a spaced distance between the acoustic perforations. According to one or more embodiments, the strength of the back plate can be prevented from lacking by making the opening area of the acoustic perforation too large, and the electrode area of the fixed electrode film can be prevented from becoming too small.

In accordance with an aspect, an inter-center distance between the adjacent acoustic perforations of the acoustic perforations having a relatively small opening area arrayed in the extraction wiring and the region in the vicinity of the extracting wiring is equal to an inter-center distance between the adjacent acoustic perforations of the acoustic perforations having a relatively large opening area arranged in other regions excluding the extraction wiring and the region in the vicinity of the extraction wiring. According to one or more embodiments, the sacrifice layer of the air gap can be uniformly etched in the manufacturing step.

In accordance with an aspect, the acoustic perforation contained in five or less zones including the acoustic perforation of the extraction wiring when counting from the acoustic perforation arranged at the extraction wiring is the acoustic perforation having a relatively small opening area. When referring to zones, this refers to the virtual line passing through the centers of a plurality of acoustic perforations at substantially equal distance from the extraction wiring. According to one or more embodiments, the strength of the back plate can be ensured and the parasitic resistance can be reduced.

In accordance with another aspect of one or more embodiments of the present invention, there is provided an acoustic sensor including: a semiconductor substrate including a back chamber; a conductive diaphragm arranged on an upper side of the semiconductor substrate; an insulating fixed film fixed on an upper surface of the semiconductor substrate to cover the diaphragm with a gap; a conductive fixed electrode film arranged on the fixed film at a position facing the diaphragm; an extraction wiring extracted from the fixed electrode film; and an electrode pad, to which the extraction wiring is connected; the acoustic sensor converting an acoustic vibration to change in electrostatic capacitance between the diaphragm and the fixed electrode film; wherein a plurality of acoustic perforations is opened in a back plate including the fixed film and the fixed electrode film; and at least the extraction wiring, of the extraction wiring and a region in the vicinity of thereof, does not include the acoustic perforation or includes an acoustic perforation of small opening rate compared to an acoustic perforation arranged in other regions (excluding a case in which an acoustic perforation is not arranged in the extraction wiring, and an opening rate of an acoustic perforation arranged in the region in the vicinity of the extraction wiring and an opening rate of an acoustic perforation arranged in other regions excluding the extraction wiring and the region in the vicinity of the extraction wiring are equal).

The opening rate is the ratio of the total of the opening area of the acoustic perforations with respect to the area of the region in the relevant region of an extent including a plurality of acoustic perforations. In order to reduce the opening rate of the acoustic perforations arranged in at least the extraction wiring of the extraction wiring and the region in the vicinity of the extraction wiring, the opening area per one acoustic perforation is to be reduced compared to the acoustic perforation in other regions excluding the extraction wiring and the region in the vicinity of the extraction wiring. Alternatively, the inter-center distance between the adjacent acoustic perforations is made longer than the acoustic perforation in other regions excluding the extraction wiring and the region in the vicinity of the extraction wiring.

The region in the vicinity of the extraction wiring refers to the region within six times and may more specifically refer to the region within substantially three times the average inter-center distance of the acoustic perforation measured from the basal end of the extraction wiring of the acoustic perforation formed region (excluding the region where the extraction wiring passes) of the back plate.

In a second acoustic sensor of one or more embodiments of the present invention, the acoustic perforation in the extraction wiring and in the region in the vicinity thereof has a relatively small opening rate, or does the acoustic perforation is not provided, and hence the width of the electrode film between the acoustic perforations in the extraction wiring and in the region in the vicinity thereof is less likely to become narrow and the parasitic resistance in the extraction wiring and in the region in the vicinity thereof can be reduced. Therefore, the generation of noise in the extraction wiring and in the region in the vicinity thereof can be reduced and the S/N ratio of the acoustic sensor can be enhanced. Furthermore, the width of the electrode film between the acoustic perforations can be widened in the extraction wiring and in the region in the vicinity thereof, so that the lowering of the strength of the fixed electrode film by the acoustic perforation in the extraction wiring and in the region in the vicinity thereof can be reduced. Therefore, the mechanical strength of the extraction wiring and the fixed electrode film increase, so that disconnection and breakage are less likely to occur.

In the second acoustic sensor of one or more embodiments of the present invention, the opening rate of the acoustic perforation is relatively large in other regions excluding the extraction wiring and the vicinity thereof so that the acoustic vibration easily passes through the acoustic perforation, and the S/N ratio of the acoustic sensor is increased to enhance the sensitivity.

A first microphone according to one or more embodiments of the present invention has a first acoustic sensor according to one or more embodiments of the present invention and a signal processing circuit for processing an electrical signal output from the acoustic sensor accommodated in a housing. According to the microphone of one or more embodiments of the present invention, the generation of noise can be reduced and the S/N ratio of the microphone can be enhanced because the acoustic sensor of one or more embodiments of the present invention is used. Furthermore, the disconnection and breakage of the extraction wiring and the fixed electrode film in the acoustic sensor are less likely to occur, and the failure of the microphone is less likely to occur.

A second microphone according to one or more embodiments of the present invention has a second acoustic sensor according to one or more embodiments of the present invention and a signal processing circuit for processing an electrical signal output from the acoustic sensor accommodated in a housing. According to the microphone of one or more embodiments of the present invention, the generation of noise can be reduced and the S/N ratio of the microphone can be enhanced because the acoustic sensor of one or more embodiments of the present invention is used. Furthermore, the disconnection and breakage of the extraction wiring and the fixed electrode film in the acoustic sensor are less likely to occur, and the failure of the microphone is less likely to occur.

One or more embodiments of the present invention have a characteristic of appropriately combining the configuring elements described above, and one or more embodiments of the present invention enables a great number of variations by the combination of the configuring elements.

DETAILED DESCRIPTION

Hereinafter, preferred embodiments of the present invention will be described with reference to the accompanied drawings. It should be noted that the present invention is not limited to the following embodiments and that various design changes can be made within a scope not deviating from the present invention. In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

First Embodiment

Figure 1:
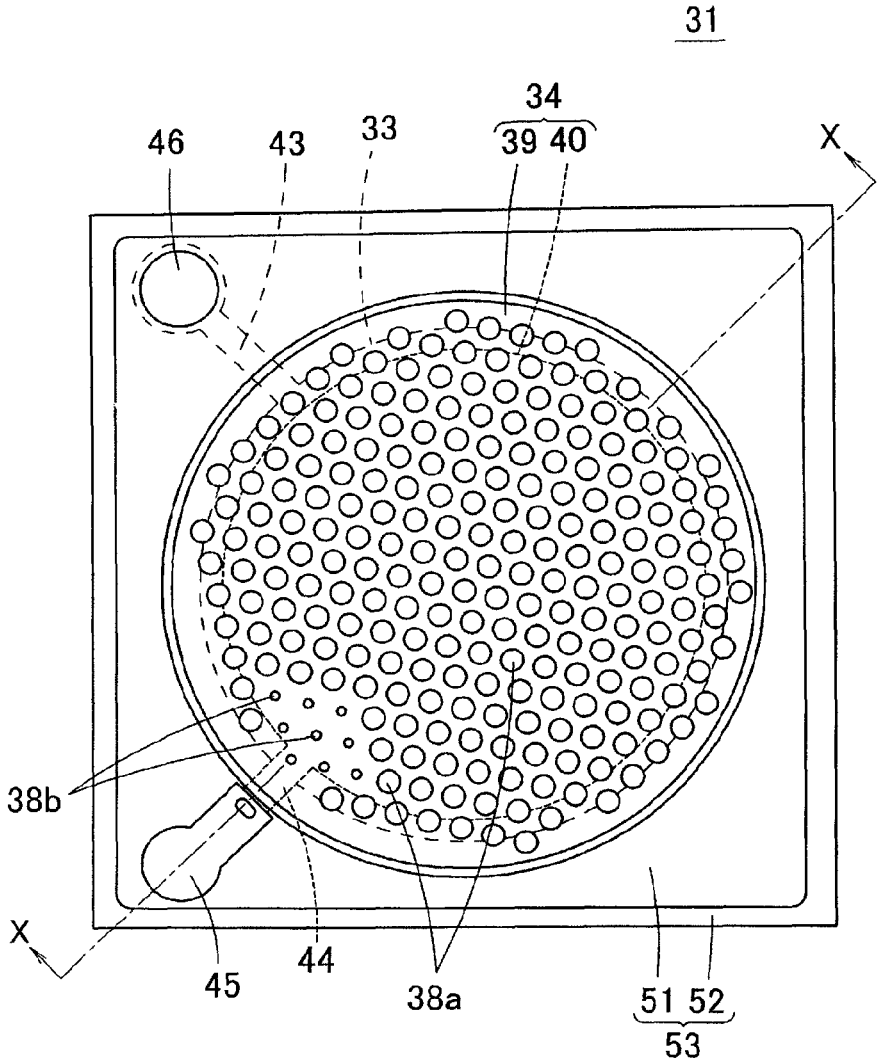
FIG. 1 is a plan view of an acoustic sensor according to a first embodiment of the present invention.
Figure 2:
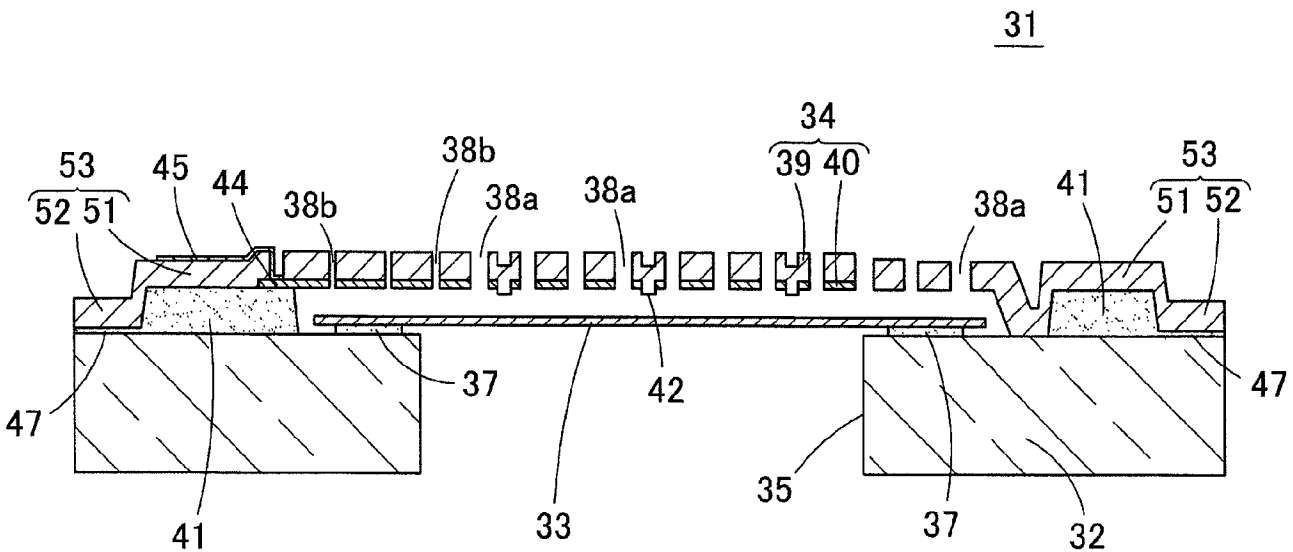
FIG. 2 is a cross-sectional view taken along line X-X of FIG. 1.

First, a structure of an acoustic sensor 31 according to a first embodiment of the present invention will be described with reference to FIG. 1 and FIG. 2. FIG. 1 is a plan view of the acoustic sensor 31. FIG. 2 is a cross-sectional view in a diagonal direction of the acoustic sensor 31 (cross-section taken along line X-X of FIG. 1).

The acoustic sensor 31 is a capacitance type element manufactured by using the MEMS technique. As shown in FIG. 2, a diaphragm 33 is arranged on an upper surface of a silicon substrate 32 (semiconductor substrate) by way of an anchor 37, and a back plate 34 is fixed thereon by way of a microscopic air gap.

The silicon substrate 32 made of monocrystalline silicon is formed with a back chamber 35 passed through from the front surface to the back surface. The inner peripheral surface of the back chamber 35 may be a perpendicular surface or may be inclined to a tapered shape.

A plurality of anchors 37 for supporting the lower surface of the outer peripheral part of the diaphragm 33 is arranged on the upper surface of the silicon substrate 32, and a base part 41 of thick film is formed on the upper surface of the silicon substrate 32 to surround the diaphragm 33. Furthermore, the region on the outer side than the base part 41 in the upper surface of the silicon substrate 32 is covered with an adhering layer 47 thinner than the base part 41. The anchor 37 and the base part 41 are formed by $SiO_2$. The adhering layer 47 is made by $SiO_2$ or polysilicon.

As shown in FIG. 1, the diaphragm 33 is formed by a substantially circular plate shaped polysilicon thin film, and has conductivity. A band plate shaped extraction wiring 43 is extended towards the outer side from the diaphragm 33.

The diaphragm 33 is arranged on the silicon substrate 32 so as to cover the opening in the upper surface of the back chamber 35. The entire periphery of the lower surface at the outer peripheral part of the diaphragm 33 is fixed to the upper surface of the silicon substrate 32 by the anchor 37. Therefore, the diaphragm 33 floats in air at the upper side of the chamber 35, and can film vibrate sympathized to the acoustic vibration (air vibration).

In the back plate 34, a fixed electrode film 40 made of polysilicon is arranged at the lower surface of a plate portion 39 (fixed film) made of nitride film (SiN). The back plate 34 has a canopy shape, and covers the diaphragm 33 at the hollow portion underneath. The height of the hollow portion under the back plate 34 (height from the upper surface of the silicon substrate 32 to the lower surface of the fixed electrode film 40) is equal to the thickness of the base part 41 formed on the upper surface of the silicon substrate 32 due to manufacturing reasons. A microscopic air gap is formed between the lower surface of the back plate 34 (i.e., lower surface of the fixed electrode film 40) and the upper surface of the diaphragm 33. The fixed electrode film 40 faces the diaphragm 33, which is a movable electrode film, and configures a capacitor.

A great number of acoustic holes 38*a*, 38*b* (acoustic perforations) for passing the acoustic vibration is performed in the back plate 34 so as to pass from the upper surface to the lower surface. The acoustic hole 38*b* formed in the extraction wiring 44 of the fixed electrode film 40 and the region in the vicinity thereof in the back plate 34 has a smaller opening area than the acoustic hole 38*a* formed in other regions (i.e., majority of the region distant from the extraction wiring 44 of the acoustic perforation formed region of the back plate 34). The acoustic holes 38*a*, 38*b* pass from the plate portion 39 to the fixed electrode film 40, where the acoustic hole of the plate portion 39 and the acoustic hole of the fixed electrode film 40 are denoted with the same reference number.

A small gap (passage of acoustic vibration) is formed between the lower surface of the outer peripheral part of the diaphragm 33 and the upper surface of the silicon substrate 32. Therefore, the acoustic vibration that entered the back plate 34 through the acoustic holes 38*a*, 38*b* vibrates the diaphragm 33 and exits to the back chamber 35 through the gap between the outer peripheral part of the diaphragm 33 and the silicon substrate 32.

A great number of microscopic stoppers 42 is projected at the inner surface of the back plate 34, so that the diaphragm 33 is prevented from being adsorbed to the lower surface of the back plate 34 and not being able to return by the electrostatic attractive force of when excess voltage is applied between the diaphragm 33 and the fixed electrode film 40. A phenomenon in which the diaphragm 33 fixes (sticks) to the back plate 34 and does not return due to the moisture that entered between the diaphragm 33 and the back plate 34 is also prevented by the stopper 42.

A protective film 53 is continuously extended over the entire periphery from the outer peripheral edge of the canopy shaped plate portion 39. Therefore, the protective film 53 is formed by a nitride film (SiN) same as the plate portion 39, and has substantially the same film thickness as the plate portion 39. The inner peripheral part of the protective film 53 is a base covering part 51 having a reverse groove shaped cross-section, and the outer peripheral part of the protective film 53 is a flat part 52.

The back plate 34 is fixed to the upper surface of the silicon substrate 32, and the protective film 53 covers the outer peripheral part of the upper surface of the silicon substrate 32 with the base part 41 and the adhering layer 47 interposed. The base covering part 51 of the protective film 53 covers the base part 41, and the flat part 52 covers the upper surface of the adhering layer 47.

The extraction wiring 43 of the diaphragm 33 is fixed to the base part 41, and the extraction wiring 44 extended from the fixed electrode film 40 is also fixed to the upper surface of the base part 41. An opening is formed in the base covering part 51, a movable side electrode pad 46 (electrode terminal) is formed on the upper surface of the extraction wiring 43 through the opening, and the movable side electrode pad 46 is conducted to the extraction wiring 43 (therefore, to the diaphragm 33). A fixed side electrode pad 45 (electrode terminal) arranged on the upper surface of the plate portion 39 is conducted to the extraction wiring 44 (therefore, to the fixed electrode film 40) through a through hole and the like.

The acoustic hole 38*b* arranged in the extraction wiring 44 or the region of in the vicinity thereof has a relatively small opening area, and the acoustic hole 38*a* formed in other regions has a relatively large opening area. The acoustic holes 38*a*, 38*b* may be entirely arrayed to a triangular shape (or honeycomb shape) as shown in FIG. 1, or may be arrayed to a square shape or a circular ring shape, or may be arrayed at random. Therefore, the spaced distance between the acoustic holes 38*a* (i.e., shortest distance between the outer peripheries of the adjacent acoustic holes) is relatively small in the region where the acoustic hole 38*a* of a large opening area is formed, and the spaced distance between the acoustic holes 38*b* is relatively large in the region where the acoustic hole 38*b* of a small opening area is formed.

Furthermore, in the acoustic sensor 31, when the acoustic vibration passes through the acoustic holes 38*a*, 38*b* and enters the space between the back plate 34 and the diaphragm 33, the diaphragm 33 or the thin film resonates to the acoustic vibration and film vibrates. When the diaphragm 33 vibrates and the gap distance between the diaphragm 33 and the fixed electrode film 40 changes, the electrostatic capacitance between the diaphragm 33 and the fixed electrode film 40 changes. As a result, in the acoustic sensor 31, the acoustic vibration (change in sound pressure) sensed by the diaphragm 33 becomes the change in the electrostatic capacitance between the diaphragm 33 and the fixed electrode film 40, and is output from the electrodes pads 45, 46 as an electrical signal.

In the acoustic sensor 31, the acoustic hole 38*a* having a relatively large opening area is formed in the region excluding the extraction wiring 44 and the region in the vicinity of the extraction wiring 44, that is, the majority of the back plate 34, and thus the acoustic vibration easily passes the acoustic holes 38*a*, 38*b*, and the S/N ratio of the acoustic sensor 31 becomes large thus enhancing the sensitivity.

Figure 3:
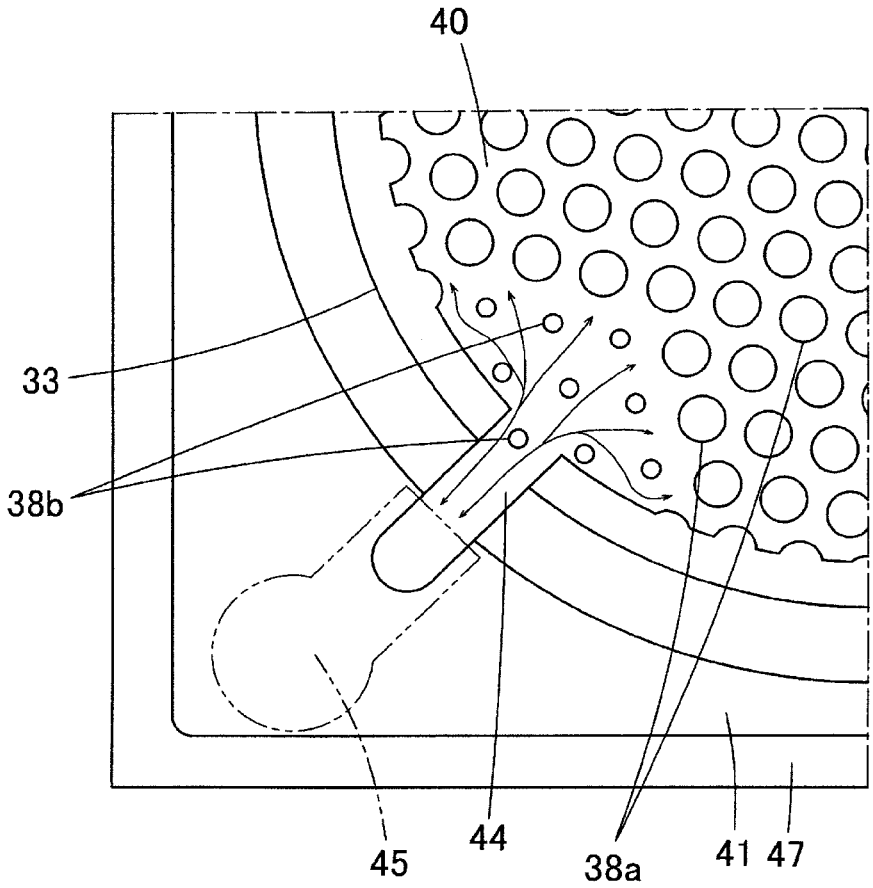
FIG. 3 is an operation explanatory view of the acoustic sensor of the first embodiment.

However, the current flows through the extraction wiring 44, as shown with an arrow in FIG. 3, between the fixed side electrode pad 45 and the fixed electrode film 40 with the change in electrostatic capacity between the diaphragm 33 and the fixed electrode film 40. Therefore, if the opening area of the acoustic hole 38*b* in the extraction wiring 44 and the region in the vicinity thereof is large, the cross-sectional area of the current passage becomes narrow and the parasitic resistance of the current passage becomes high. If the parasitic resistance becomes high, the electrical noise generated from the resistor body increases thus degrading the characteristics of the acoustic sensor.

In the acoustic sensor 31, on the other hand, the opening area of the acoustic hole 38*b* formed in the extraction wiring 44 and in the region in the vicinity thereof is relatively small, and thus the cross-sectional area of the extraction wiring 44 and the current passage in the fixed electrode film 40 is less likely to become narrow by the acoustic hole 38*b*, and the parasitic resistance of the current flowing as shown with an arrow in FIG. 3 becomes smaller. Therefore, the parasitic resistance can be reduced and the noise can be reduced in the extraction wiring 44 and in the region of the vicinity thereof, and the S/N ratio of the sensor can be enhanced. As a result, the S/N ratio of the acoustic sensor 31 can be efficiently enhanced by the combination of the acoustic hole 38*a* having a relatively large opening area and the acoustic hole 38*b* having a relatively small opening area.

The portion of the extraction wiring 44 has a narrow width and thus has low strength, where the strength further lowers as the acoustic hole 38*b* is opened. The tip of the extraction wiring 44 is fixed to the base part 41, so that stress easily concentrates at an area connected to the extraction wiring 44 of the fixed electrode film 40 and the strength also lowers by the acoustic hole 38*b*. Therefore, if the acoustic hole of a large opening area is formed, the extraction wiring 44 or the fixed electrode film 40 may break or disconnect at the extraction wiring 44 or the region in the vicinity thereof, and the acoustic sensor 31 may stop its function.

In the acoustic sensor 31, on the other hand, the opening area of the acoustic hole 38*b* is formed small in the extraction wiring 44 and in the region in the vicinity thereof, so that the lowering of strength caused by the acoustic hole 38*b* in the extraction wiring 44 and in the region in the vicinity thereof can be reduced. Therefore, in the acoustic sensor 31, disconnection and breakage are less likely to occur in the extraction wiring 44 and the fixed electrode film 40, and the mechanical strength of the acoustic sensor 31 enhances.

The relationship between the size and the pitch of the acoustic holes 38*a*, 38*b* for improving the characteristics of the acoustic sensor 31 will now be described. The acoustic holes 38*a*, 38*b* are substantially circular openings and are regularly arrayed.

Figure 4:
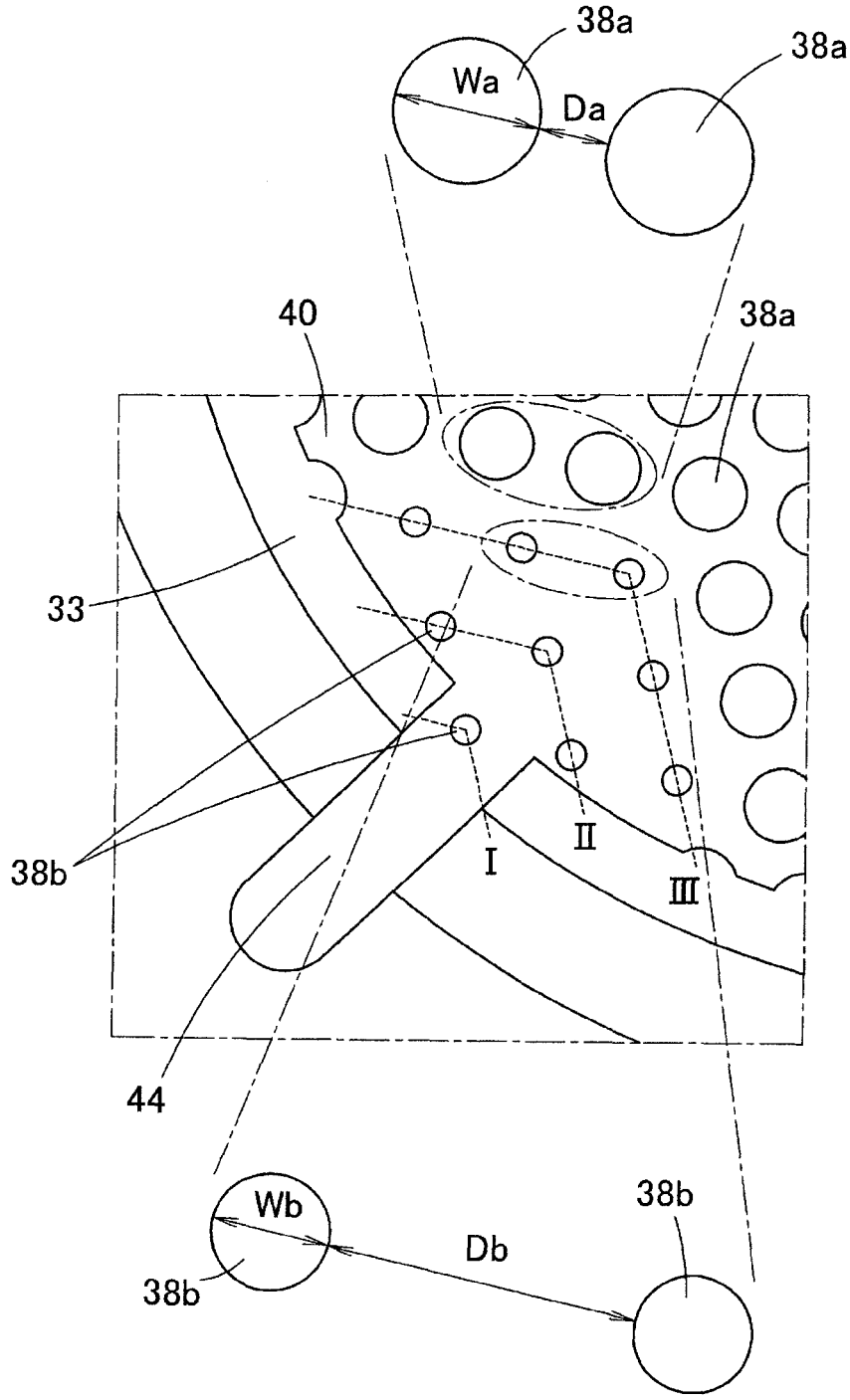
FIG. 4 is a view describing the arrangement of acoustic holes in the acoustic sensor of the first embodiment.

The acoustic hole 38*a* having a relatively large opening area in the region distant from the extraction wiring 44 will be described. As shown in FIG. 4, the array pitch (inter-center distance) of the acoustic hole 38*a* is Wa+Da, where Wa is the diameter of the acoustic hole 38*a* having a large opening area and Da is the spaced distance between the acoustic holes 38*a*. The spaced distance Da×the thickness of the fixed electrode film 40 represents the cross-sectional area of the current passage with respect to the current flowing between the acoustic holes 38*a*.

First of all, the opening rate of the acoustic hole 38*a* may be set large in the region distant from the extraction wiring 44 to enhance the S/N ratio of the acoustic sensor 31.

Diameter Wa>Spaced distance Da is desirable.

The spaced distance Da between the acoustic holes 38*a* is desirably made as narrow as possible to efficiently escape the thermal noise generated in the air gap between the diaphragm 33 and the fixed electrode film 40. However, if the spaced distance between the acoustic holes 38*a* is narrowed in excess, the strength of the back plate 34 may lack or the electrode area of the fixed electrode film 40 may reduce. Therefore, $$Da>0.25\times Wa$$

is recommended. Therefore, the spaced distance Da between the acoustic holes 38*a* may be as narrow as possible, with a lower limit of 0.25Wa.

Summarizing the above, the condition $$0.25\times Wa<Da<Wa \text{ is obtained.}$$

If the diameter Wa of the acoustic hole 38*a* is excessively small, the sacrifice layer present in the back plate 34 may not be etched in the manufacturing step or thermal noise may generate inside the acoustic hole 38*a*. The diameter Wa of the acoustic hole 38*a* is desirably greater than or equal to 3 μm. For instance, if Wa=16 μm and Da=8 μm, the thermal noise in the air gap becomes small and high S/N ratio can be obtained.

The acoustic hole 38*b* having a relatively small opening area in the extraction wiring 44 and the region in the vicinity thereof will now be described. As shown in FIG. 4, the array pitch of the acoustic hole 38*b* is Wb+Db, where Wb is the diameter of the acoustic hole 38*b* having a small opening area and Db is the spaced distance between the acoustic holes 38*b*. The spaced distance Db×the thickness of the fixed electrode film 40 represents the cross-sectional area of the current passage with respect to the current flowing between the acoustic holes 38*b*.

The ensuring of the strength of the fixed electrode film 40 and the reduction of the parasitic resistance need to be prioritized in the vicinity of the extraction wiring 44, and thus the spaced distance Db between the acoustic holes 38*b* is desirably wide. In particular, the spaced distance Db is to be greater than the radius of the acoustic hole 38*b* (e.g., Db>0.5×Wb) to have the fixed electrode film 40 sufficiently strong. The array pitch Wb+Db of the acoustic holes 38*b* in the extraction wiring 44 and the region in the vicinity thereof may be equal to the array pitch Wa+Da of the acoustic holes 38*a* in the region distant from the extraction wiring 44 to uniformly etch the sacrifice layer of the air gap. That is, Da<Db because Wa>Wb when Wb+Db=Wa+Da. Therefore, if the arrangement of the acoustic hole 38*a* is such that Wa=16 μm and Da=8 μm, the fixed electrode film 40 can have sufficient strength and the sacrifice layer can be uniformly etched if the arrangement of the acoustic holes 38*b* is Wb=10 μm and Db=14 μm.

From the standpoint of ensuring the strength of the back plate 34 and reducing the parasitic resistance, the area for forming the acoustic hole 38*b* having a small opening area is desirably between one or more zones, also referred to as sections, and five or less zones, or sections. The thermal noise of the air gap cannot be reduced and the S/N ratio of the acoustic sensor 31 may be degraded if six or more zones, or sections. With regards to the zone or section of the acoustic hole 38*b*, a set of acoustic holes 38*b* arranged continuously (in particular, lined in short interval and assumed as continuous) is assumed as one section. For instance, in the example of FIG. 4, three sections, or zones, are provided, where the first section/zone (I) includes one acoustic hole 38*b* including the extraction wiring 44, the second section/zone (II) includes three acoustic holes 38*b* (e.g., acoustic hole 38*b* positioned on a hexagon in which the distance from the acoustic hole 38*b* of the first section (I) to the corner is Wb+Db), and the third section/zone (III) includes five acoustic holes 38*b* (acoustic hole 38*b* positioned on a hexagon in which the distance from the acoustic hole 38*b* of the first section (I) to the corner is 2Wb+2 Db). In the example of FIG. 4, the interval of the acoustic holes 38*b* is the same in all directions, and thus one section is defined in the direction the acoustic holes 38*b* are lined as much as possible.

Second Embodiment

Figure 5:
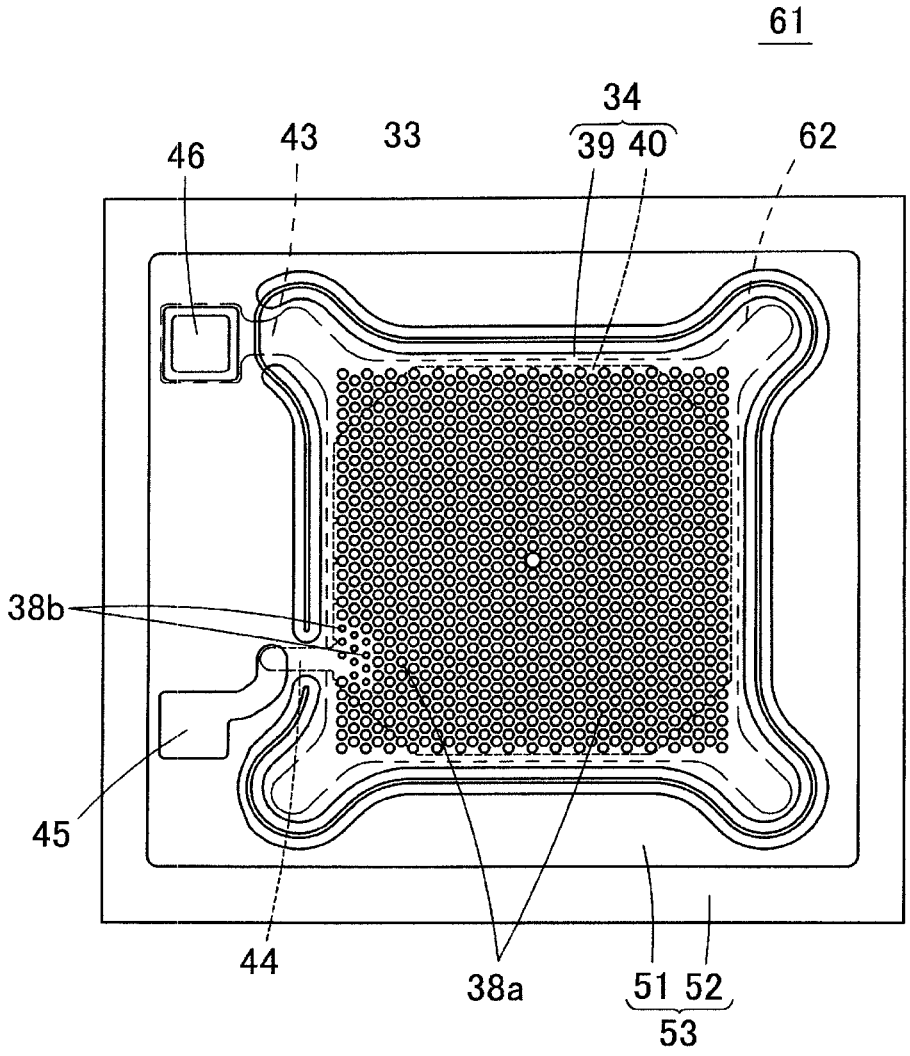
FIG. 5 is a plan view of an acoustic sensor according to a second embodiment of the present invention.
Figure 6:
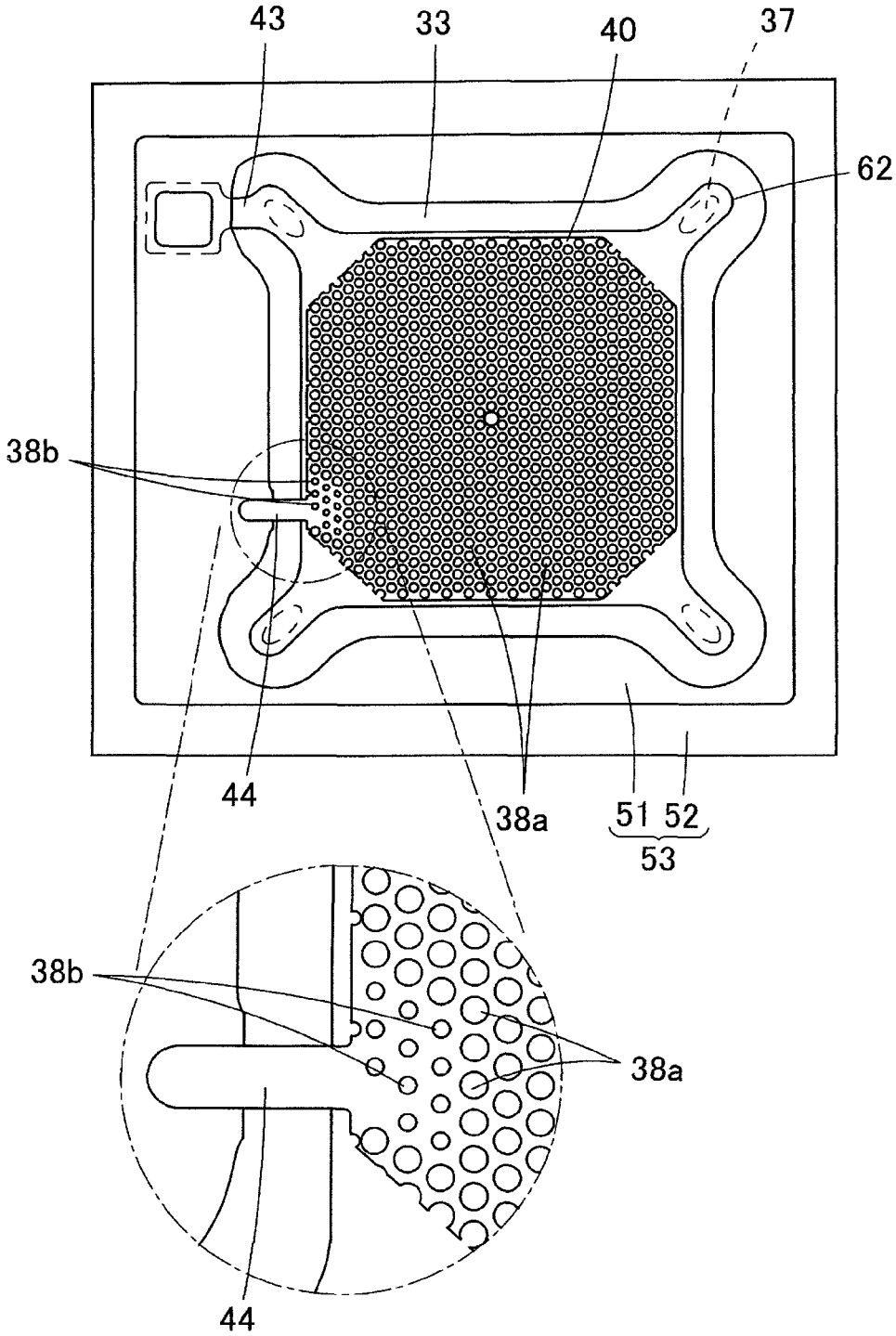
FIG. 6 is a plan view of a state in which the plate portion of the back plate is removed in the acoustic sensor of the second embodiment.

An acoustic sensor according to a second embodiment of the present invention will be described. FIG. 5 is a plan view of an acoustic sensor 61 according to a second embodiment of the present invention. FIG. 6 is a plan view showing the acoustic sensor 61 in which the plate portion 39 is omitted, and also shows one part in an enlarged manner.

The acoustic sensor 61 of the second embodiment has a structure substantially similar to the acoustic sensor 31 of the first embodiment other than that the diaphragm 33 and the back plate 34 are formed to a substantially square shape, and hence the same reference numerals are denoted for the portions of the same structure as the first embodiment in the figures and the description thereof will be omitted.

As shown in FIG. 6, the diaphragm 33 is formed to a substantially square shape in the acoustic sensor 61, where a beam 62 is extended in the diagonal direction from the four corners. The diaphragm 33 has the lower surface of each beam 62 supported by the anchor 37 arranged on the upper surface of the silicon substrate 32 by $SiO_2$.

In the acoustic sensor 61 as well, the acoustic hole 38*b* having a small opening area is formed in the region in the vicinity of the extraction wiring 44 extended from the fixed electrode film 40, and the acoustic hole 38*a* having a large opening area is formed in the region distant from the extraction wiring 44. The acoustic holes 38*b* are arranged at the same array pitch as the acoustic holes 38*a* so as to form three sections/zones.

Third Embodiment

Figure 7:
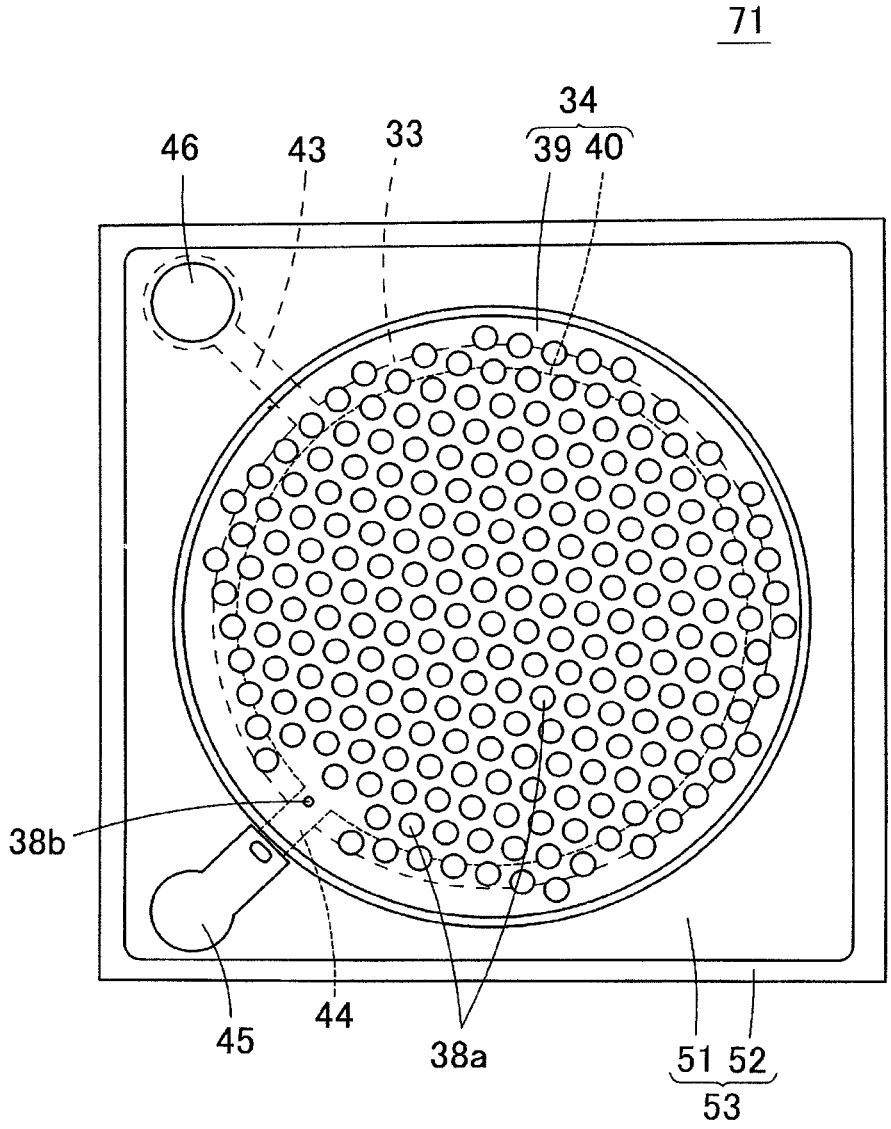
FIG. 7 is a plan view of an acoustic sensor according to a third embodiment of the present invention.

An acoustic sensor according to a third embodiment of the present invention will now be described. FIG. 7 is a plan view of an acoustic sensor 71 according to the third embodiment of the present invention.

In the acoustic sensor 71 of the third embodiment, one or a plurality of acoustic holes 38*b* having a small opening area is formed in the extraction wiring 44, and only the acoustic hole 38*b* at the extraction wiring 44 is assumed as the acoustic hole having a small opening area. The acoustic holes 38*a* having a large opening area is regularly arrayed in the region other than the region where the extraction wiring 44 is passed. However, some of the acoustic holes 38*a* are omitted from the acoustic holes 38*a* arrayed regularly in the region in the vicinity of the extraction wiring 44, so that the number density of the acoustic holes 38*a* is reduced than the region distant from the extraction wiring 44 so that the array pitch of the acoustic holes 38*a* is reduced.

In the present embodiment, the opening rate of the acoustic hole is made small by reducing the opening area of the acoustic hole 38*b* in the extraction wiring 44. Furthermore, the opening rate of the acoustic hole is made small by reducing the number density of the acoustic hole 38*a* in the region in the vicinity of the extraction wiring 44.

The embodiment of FIG. 7 can be assumed that the acoustic hole 38*b* having a small opening area is provided at the extraction wiring 44 and the acoustic hole is not provided (i.e., opening rate is zero) in the region in the vicinity of the extraction wiring 44.

Furthermore, the opening rate may be made small only in the region where the extraction wiring 44 is passed as described next. In other words, the opening rate is made small by providing the acoustic hole 38*b* having a small opening area in the extraction wiring 44. The acoustic hole 38*a* having a large opening area may be regularly arrayed in the region other than the region where the extraction wiring 44 is passed, so that the region in the vicinity of the extraction wiring 44 has an opening rate same as the region distant from the extraction wiring 44.

Fourth Embodiment

Figure 8:
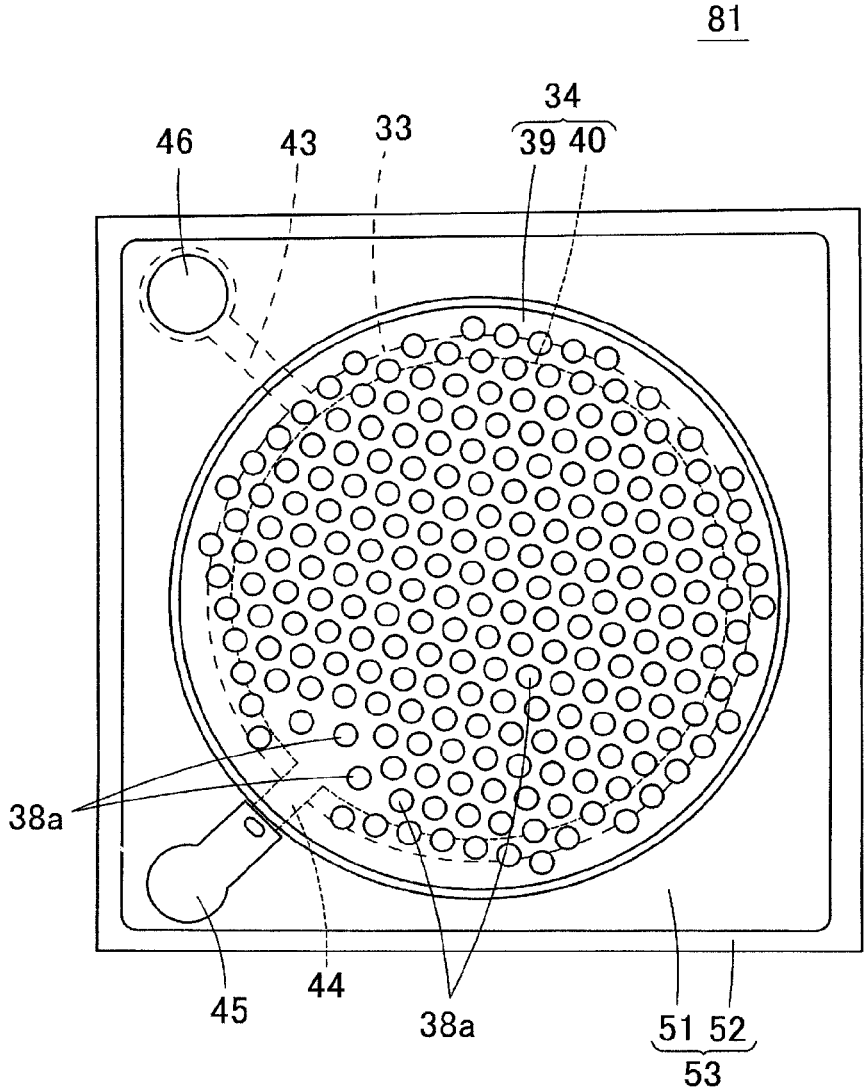
FIG. 8 is a plan view of an acoustic sensor according to a fourth embodiment of the present invention.

An acoustic sensor according to a fourth embodiment of the present invention will be described. FIG. 8 is a plan view of an acoustic sensor 81 according to a fourth embodiment of the present invention.

In the acoustic sensor 81 of the fourth embodiment, the acoustic hole 38*a* is formed in the region other than the region where the extraction wiring 44 is passed. The acoustic holes 38*a* all have an opening area (i.e., opening size) of the same size. The acoustic holes 38*a* are regularly arrayed so that the spaced distance between the adjacent acoustic holes 38*a* becomes relatively small in the acoustic hole 38*a* in the region distant from the extraction wiring 44. The acoustic holes 38*a* are arranged irregularly or at random so that the spaced distance between the acoustic holes 38*a* becomes greater than the region distant from the extraction wiring 44 in the region in the vicinity of the extraction wiring 44.

In the present embodiment, the opening rate is zero because the acoustic hole is not provided at the extraction wiring 44, and the number density of the acoustic hole 38*a* is small and the opening rate thereof is smaller than the region distant from the extraction wiring 44 in the region in the vicinity of the extraction wiring 44.

In the embodiment of FIG. 8, the small acoustic hole 38*b* may be provided at the extraction wiring 44.

Fifth Embodiment

Figure 9:
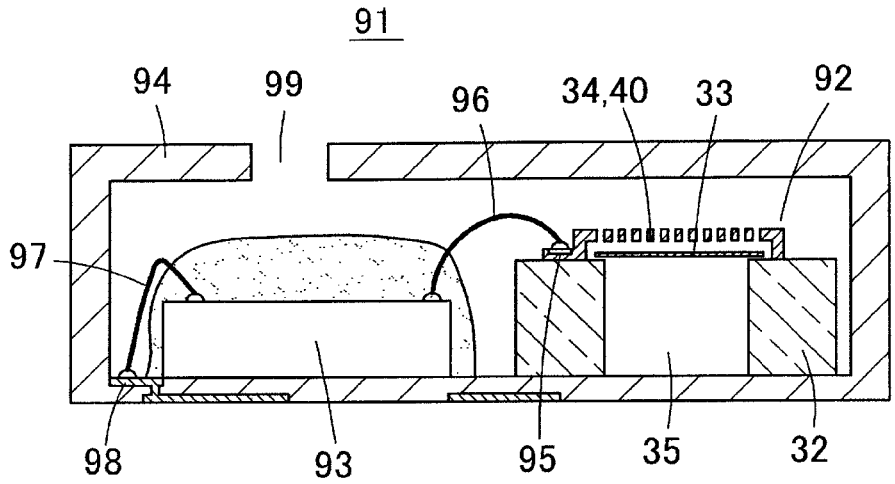
FIG. 9 is a schematic cross-sectional view of a microphone according to a fifth embodiment of the present invention.

FIG. 9 is a schematic cross-sectional view showing a microphone 91 according to a fifth embodiment of the present invention. As shown in FIG. 9, an acoustic sensor 92 is mounted in a package 94 along with an IC circuit 93 (signal processing circuit), where an electrode pad 95 of the acoustic sensor 92 and the IC circuit 93 are wire connected with a bonding wire 96, and the IC circuit 93 is wire connected to an electrode portion 98 of the package 94 with a bonding wire 97. An acoustic vibration introducing hole 99 for introducing the acoustic vibration into the package 94 is opened at the upper surface of the package 94.

Therefore, when the acoustic vibration enters the package 94 from the acoustic vibration introducing hole 99, such acoustic vibration is detected by the acoustic sensor 92. The electrostatic capacitance between the diaphragm 33 and the fixed electrode film 40 changes by the acoustic vibration, and such change in electrostatic capacitance is output to the IC circuit 93 as an electrical signal. The IC circuit 93 performs a predetermined signal processing on the electrical signal output from the acoustic sensor 92 so that it can be output to the outside from the electrode portion 98.

LEGEND

Acoustic sensor 31
Silicon substrate 32 (semiconductor substrate)
Diaphragm 33
Back plate 34
Back chamber 35
Anchor 37
Acoustic holes 38*a*, 38*b* (acoustic perforations)
Plate portion 39 (fixed film)
Fixed electrode film 40
Base part 41
Microscopic stoppers 42
Band plate shaped extraction wiring 43
Extraction wiring 44
Fixed side electrode pad 45 (electrode terminal)
Movable side electrode pad 46 (electrode terminal)
Adhering layer 47
Base covering part 51
Flat part 52
Protective film 53
Acoustic sensor 61
Beam 62
Acoustic sensor 71
Acoustic sensor 81
Microphone 91
Acoustic sensor 92
IC circuit 93 (signal processing circuit)
Package 94
Electrode pad 95
Bonding wire 96
Bonding wire 97
Electrode portion 98
Acoustic vibration introducing hole 99

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. An acoustic sensor comprising:

a semiconductor substrate comprising a back chamber;

a conductive diaphragm arranged on an upper side of the semiconductor substrate;

an insulating fixed film fixed on an upper surface of the semiconductor substrate to cover the conductive diaphragm with a gap;

a conductive fixed electrode film arranged on the insulating fixed film at a position facing the conductive diaphragm;

an extraction wiring extracted from the conductive fixed electrode film; and an electrode pad, to which the extraction wiring is connected, wherein the acoustic sensor converts an acoustic vibration to change electrostatic capacitance between the conductive diaphragm and the conductive fixed electrode film, wherein a plurality of acoustic perforations are opened in a back plate comprising the insulating fixed film and the conductive fixed electrode film, and wherein an opening rate of the plurality of acoustic perforations is smaller in the extraction wiring and a region in the vicinity thereof than in other regions.

2. The acoustic sensor according to claim 1, wherein an opening area per one acoustic perforation is smaller in the extraction wiring and a region in the vicinity thereof than in other regions.

3. The acoustic sensor according to claim 1, wherein an inter-center distance between adjacent acoustic perforations is longer in the extraction wiring and a region in the vicinity thereof than in other regions.

4. The acoustic sensor according to claim 2, wherein the acoustic perforation arranged in the extraction wiring and in the region in the vicinity of the extraction wiring, and the acoustic perforation in other regions, excluding the extraction wiring and in the region in the vicinity of the extraction wiring, are arrayed according to a same rule.

5. The acoustic sensor according to claim 2, wherein a diameter of the acoustic perforation having a relatively small opening area arranged in the extraction wiring or the region in the vicinity of the extraction wiring is smaller than twice a spaced distance between the acoustic perforations.

6. The acoustic sensor according to claim 2, wherein a diameter of the acoustic perforation having a relatively large opening area arranged in other regions, excluding the extraction wiring and the region in the vicinity of the extraction wiring, is greater than a spaced distance between the acoustic perforations.

7. The acoustic sensor according to claim 2, wherein a diameter of the acoustic perforation having a relatively large opening area arranged in other regions, excluding the extraction wiring and the region in the vicinity of the extraction wiring, is smaller than four times a spaced distance between the acoustic perforations.

8. The acoustic sensor according to claim 2, wherein an inter-center distance between the adjacent acoustic perforations of the acoustic perforations having a relatively small opening area arrayed in the extraction wiring and the region in the vicinity of the extracting wiring is equal to an inter-center distance between the adjacent acoustic perforations of the acoustic perforations having a relatively large opening area arranged in other regions, excluding the extraction wiring and the region in the vicinity of the extraction wiring.

9. The acoustic sensor according to claim 2, wherein the acoustic perforation contained in five or less zones, including the acoustic perforation of the extraction wiring when counting from the acoustic perforation arranged at the extraction wiring, is the acoustic perforation having a relatively small opening area.

10. An acoustic sensor comprising:

a semiconductor substrate comprising a back chamber;

a conductive diaphragm arranged on an upper side of the semiconductor substrate;

an insulating fixed film fixed on an upper surface of the semiconductor substrate to cover the conductive diaphragm with a gap;

a conductive fixed electrode film arranged on the insulating fixed film at a position facing the conductive diaphragm;

an extraction wiring extracted from the conductive fixed electrode film; and an electrode pad, to which the extraction wiring is connected, wherein the acoustic sensor converts an acoustic vibration to change electrostatic capacitance between the conductive diaphragm and the conductive fixed electrode film, wherein a plurality of acoustic perforations are opened in a back plate comprising the insulating fixed film and the conductive fixed electrode film, and wherein at least the extraction wiring, and a region in the vicinity thereof, does not comprise the acoustic perforation or comprise an acoustic perforation of small opening rate compared to an acoustic perforation arranged in other regions, except in a case in which an acoustic perforation is not arranged in the extraction wiring, and an opening rate of an acoustic perforation arranged in the region in the vicinity of the extraction wiring and an opening rate of an acoustic perforation arranged in other regions, excluding the extraction wiring and the region in the vicinity of the extraction wiring, are equal.

11. A microphone in which the acoustic sensor according to claim 1 and a signal processing circuit for processing an electrical signal output from the acoustic sensor are accommodated in a housing.

12. A microphone in which the acoustic sensor according to claim 10 and a signal processing circuit for processing an electrical signal output from the acoustic sensor are accommodated in a housing.

* * * * *